United States Patent [19]

Mackay et al.

[11] 4,377,422

[45] Mar. 22, 1983

[54] HADFIELD'S STEEL CONTAINING 2% VANADIUM

[75] Inventors: William B. Mackay, Ravensview; Reginald W. Smith, Inverary, both of Canada

[73] Assignee: Queen's University at Kingston, Kingston, Canada

[21] Appl. No.: 300,134

[22] Filed: Sep. 8, 1981

[30] Foreign Application Priority Data

Sep. 12, 1980 [CA] Canada ..... 360168

[51] Int. Cl.[3] ..... C22D 38/04; C22D 38/12

[52] U.S. Cl. ..... 148/137; 75/123 N; 75/123 J; 148/31

[58] Field of Search ..... 75/123 N, 123 J; 148/31, 137

[56] References Cited

U.S. PATENT DOCUMENTS

| | | | |
|---|---|---|---|
| 3,075,838 | 1/1963 | Avery et al. | 75/123 N |
| 3,330,651 | 7/1967 | Younkin | 75/123 N |
| 3,864,123 | 2/1975 | Sakwaet al. | 75/123 N |

FOREIGN PATENT DOCUMENTS

| | | | |
|---|---|---|---|
| 369918 | 2/1933 | United Kingdom | 75/123 N |
| 491673 | 9/1938 | United Kingdom | 75/123 N |
| 1428060 | 3/1976 | United Kingdom | 75/123 N |

*Primary Examiner*—W. Stallard

*Attorney, Agent, or Firm*—Richard J. Hicks; Stanley E. Johnson

[57] ABSTRACT

An abrasion resistant heat treated austenitic manganese steel containing about 1% carbon, 13% manganese and 1.2–2.0% vanadium. The steels are heat treated so as to disperse austenitic grain boundary vanadium carbides uniformly throughout the matrix.

4 Claims, 7 Drawing Figures

HADFIELD'S STEEL CONTAINING 2% VANADIUM

This invention relates to improvements in austenitic manganese steel alloys of the type generally referred to as "Hadfield's Steel". Hadfield's steel was developed in the late 1880's and in its simplest form contains about 1.0 to 1.4 percent carbon, 10 to 14 percent manganese, up to about 1% silicon, up to about 0.06% sulphur, up to about 0.12% phosphorus and the balance iron. Hadfield's steel is generally, but not necessarily, used in the form of castings in many diverse applications, such as wear plates, railroad frogs and crossovers, where its extremely tough, non-magnetic, and wear resistant properties can be used to advantage. Over the years many attempts have been made to improve the impact and wear resistance of the basic Hadfield's steel and numerous alloying additions have been suggested. Of many available alloying additions it has been established (Avery & Day, A.S.M. Handbook 1948 Edition, pp. 526–534) that for a number of dilute alloys the curve for vanadium has the steepest slope in a graph of yield strength versus the percentage of alloying element. Grigorkin et al (Metallovedenie i Termicheskaya obrabotka Metallov (1974), No. 4, 68–71) have shown that several small alloying additions, including 0.48% vanadium, has a beneficial effect on yield strength and wear resistance, depending upon the type of heat treatment given to the cast alloy. Ridenour and Avery in Canadian Pat. No. 894,713 issued Mar. 7, 1972 investigated the use of up to 2% vanadium additions and concluded that the addition of 0.5% vanadium increases the yield strength of properly toughened Hadfield's steel from about 54,000 psi to about 60,000 psi. If larger amounts of vanadium are employed the toughness (tensile elongation) is seriously reduced. At 2.0% vanadium although the yield strength may be as high as 80,000 psi the ductility (toughness) is reduced to less than 5% and is therefore quite unacceptable for railroad service which demands a higher level of ductility as a safety factor.

In considering wear resistance it is believed important to consider the type of wear to which the alloy is subjected. In railroad uses such as frogs and crossovers the wear is of the high impact type and clearly maximum ductility is required to withstand the battering effect over a long period of time. In mining uses, however, such as wear plates in crushers or in bucket teeth in loading equipment, the wear is of the grinding or abrasive type which calls for an extremely hard material with far less emphasis on the yield strength.

It is an object of the present invention to provide an improved abrasion resistant austenitic manganese steel alloy of the Hadfield type, containing vanadium.

Thus by one aspect of this invention there is provided a heat treated abrasion resistant manganese steel alloy consisting essentially of about:

carbon: 1.1 to 1.4%
manganese: 10 to 14%
silicon: 1% max.
sulphur: 0.06% max.
phosphorus: 0.12% max.
vanadium: 1.2 to 2%
iron: balance having an austenitic matrix structure with vanadium carbide particles substantially uniformly distributed therein.

By another aspect there is provided a method of heat treating an alloy consisting essentially of:

carbon: 1.1 to 1.4%
manganese: 10 to 14%
silicon: 1% max.
sulphur: 0.06% max.
phosphorus: 0.12% max.
vanadium: 1.2 to 2%
iron: balance comprising soaking said alloy at a temperature in the range 1050°–1150° C. for at least 6 hours per inch of section and water quenching.

By yet another aspect there is provided a method of heat treating an alloy consisting essentially of:

carbon: 1.1 to 1.4%
manganese: 10 to 14%
silicon: 1% max.
sulphur: 0.06% max.
phosphorus: 0.12% max.
vanadium: 1.2 to 2%
iron: balance comprising soaking said alloy at a temperature in the range 1100°–1150° C. for at least 30 minutes per inch of section, water quenching, annealing at 950° C. for at least 6 hours per inch of section and water quenching.

The invention will be described in more detail hereinafter with reference to the accompanying drawings in which.

Figure 1:
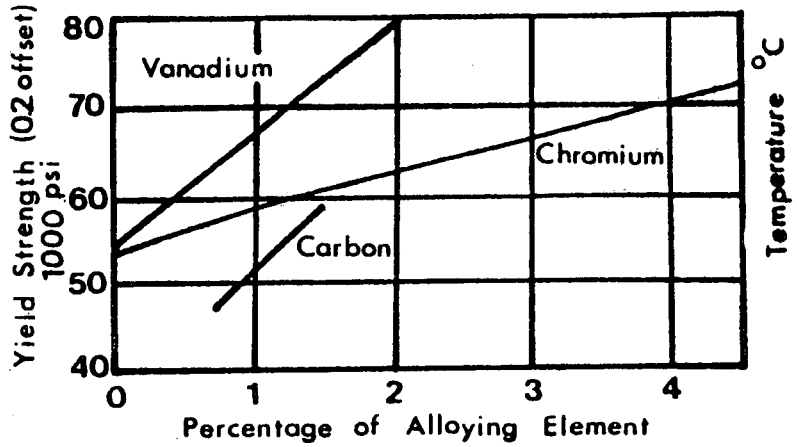
FIG. 1 is a graph illustrating the effect of alloying elements on the yield strength of austenitic manganese steel.
Figure 5:
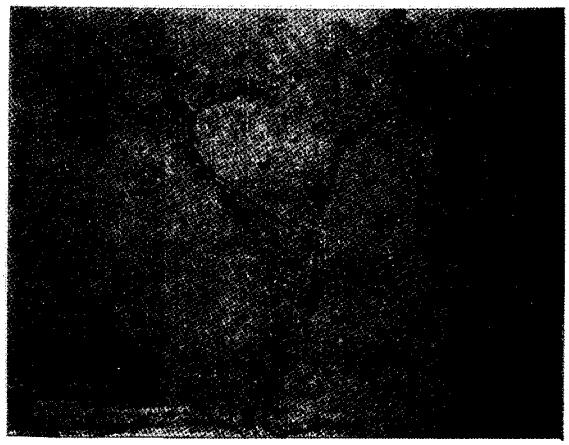
FIG. 5 is a photomicrograph (×500) of a 1.88%V 12.5% Mn 0.75%C. austenitic manganese steel heat treated at 750° C.

As noted above it has previously been shown that vanadium is a prime candidate for selection as an alloying addition in Hadfield manganese steels and FIG. 1 illustrates that on the basis of yield strength versus the percentage of alloying element in a number of dilute alloys, vanadium has the steepest slope. The prior work has also shown, however, that as the yield strength increases with increasing vanadium content the toughness (as measured by tensile elongation) falls considerably so that the alloys are not suitable for railway use in high impact wear applications. Without wishing to be bound by this explanation, it is believed that the reduction in tensile elongation is due to the presence of grain boundary precipitation of vanadium carbides as seen in FIG. 5.

Figure 2:
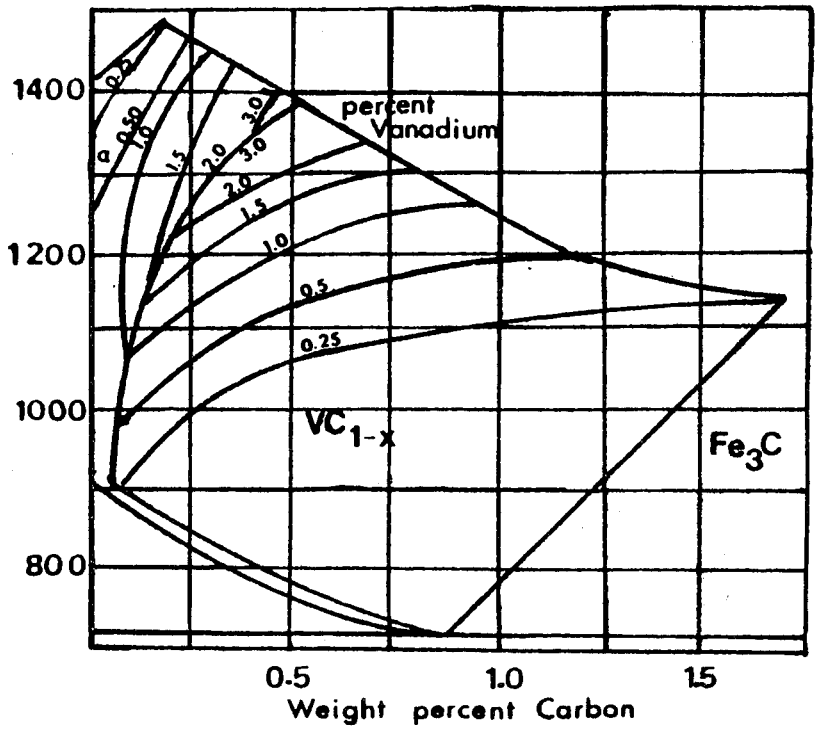
FIG. 2 is a graph illustrating the solubility range of vanadium carbide in austenite.

The Fe-V-Mn-C phase diagram has not been well documented but it has been indicated that the austenite vanadium carbide field in the system C-Fe-V starts from about 700° C. for a range of vanadium contents. It has also been shown that vanadium carbide is very stable but enters into solution above 1100° C., depending on the concentration of vanadium and carbon. Recent work suggests that the vanadium carbide formed is not stoicheiometric VC or $V_4C_3$. It has been given the general composition $VC_{1-X}$ were X is a function dependent on the extent to which the interstitial C sites in the f.c.c. structure are filled. FIG. 2 illustrates the solubility range of vanadium carbide in austenite. It is therefore an aim of the present invention to heat treat a 1.2–2%V Hadfield steel to remove the as-cast structure and disperse the carbides throughout the matrix.

EXAMPLE

In order to carry the present invention into practice, Hadfield steel scrap from used railway frogs was melted in a 100 KVA Tocco® Induction Furnace. The melt was then transferred via a ladle to a hot 20 lb. 30 KVA Tocco® Furnace, containing preheated alloying additions as required to bring the melting stock to the desired composition. The change was shielded with an argon blanket and power was applied to effect complete melting and superheating before being cast. In this way a melt of any desired composition could be produced in 10–15 minutes. All alloying elements were wrapped in aluminum foil when placed in the 20 lb. 30 KVA furnace. The amount of aluminium was sufficient to deoxidize the melt. The vanadium carbide was added as "Carvan"®, an alloy sold by Union Carbide Metals Company and typically analysing 84.5%V, 0.05% Si, 12.25%C, 0.0005% Al, 0.004%S, 0.004%P and 2.5%Fe. In order to raise the carbon content Union Carbide 3–10 graphite particles were added. After alloying, each melt was brought to 1600°–1650° C. and then poured directly into green olivine sand moulds or fired investments (for tensile testing purposes). Ten heats were made in this way and analysed as set forth in Table I.

TABLE I

| HEAT | CARBON % | MANGANESE % | VANADIUM % |
|---|---|---|---|
| 1 | .77 | 13.2 | 0.74 |
| 2 | .75 | 12.5 | 1.88 |
| 3 | 1.12 | 12.2 | 3.53 |
| 4 | 1.22 | 13.0 | 0.53 |
| 5 | 1.42 | 13.2 | 1.27 |
| 6 | 1.14 | 12.7 | 0.12 |
| 7 | 1.27 | 12.6 | 0.47 |
| 8 | 1.38 | 13.1 | 0.96 |
| 9 | 1.50 | 12.8 | 2.22 |
| 10 | 1.23 | 12.7 | 3.29 |

Figure 6:
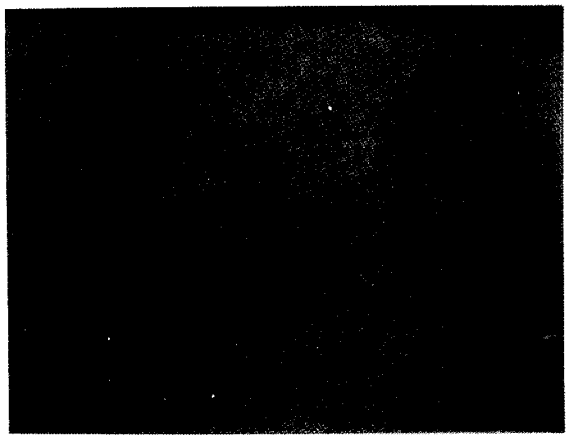
FIG. 6 is a photomicrograph (×500) of the steel of FIG. 5 single stage heat treated at 1050° C.
Figure 7:
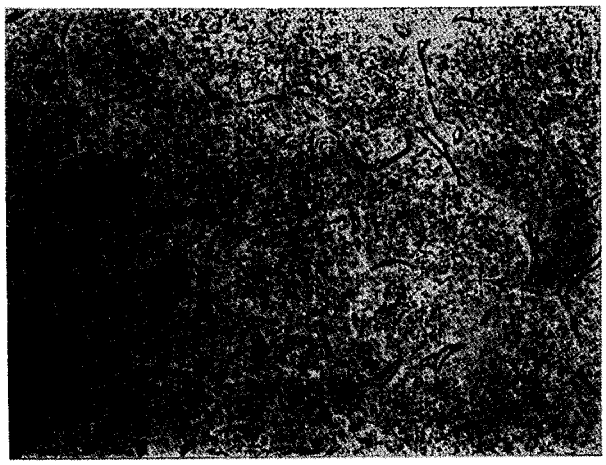
FIG. 7 is a photomicrograph (×500) of the steel of FIG. 5 double stage heat treated at 1150° C. and 950° C.

Samples of each of the steels shown in Table I were heat treated by soaking 25×30×15 mm specimens at a selected temperature within the range 750° C. to 1150° C. in an air atmosphere for 6 hours, i.e. 6 hours per inch of section. The specimens were then quenched in water. Brinell hardness measurements were taken and it was found that hardness decreased uniformly as treatment temperature increased. Photomicrographic studies were also carried out on each specimen and it was found that at lower treatment temperatures (and generally at higher vanadium contents) there is a continuous grain boundary network structure of vanadium carbide around the austenite of the matrix, as illustrated in FIG. 5 which is a 500× micrograph of the steel of Heat 2 etched in 2% nital followed by 15% HCl to remove staining. This structure was, however, disrupted at higher temperatures and the carbides were dispersed throughout out the austenite matrix as seen in FIG. 6 which represents heat treatment of heat 2 steel at 1050° C. and water quenching. The treatment at 1050° C. was selected as the standard Type I treatment for the wear and impact testing described hereinafter. At lower vanadium contents the carbides tended not to show a fine dispersion in the matrix but to coalesce in large localizations and a double heat treatment such as that suggested by Grigorkin et al, supra, was found beneficial in effecting dispersion of the vanadium carbides throughout the matrix. Samples, as before, were austenitized at 1100° C. for 30 minutes, water quenched and then soaked at 950° C. for 6 hours and finally water quenched again. The first anneal removed the as-cast structure and the second anneal dispersed the carbides throughout the matrix and then effect some coalescing thereof. A typical example of the structure achieved with the double or Type II heat treatment described is illustrated in FIG. 7.

Wear and impact tests were also carried out on a series of specimens. Wear testing was accomplished by grinding a weighed sample, which had been preground to the contour of a modified grinding wheel, for 30 seconds under a standard load and then reweighing. Wear resistance was calculated by weight loss. Between each test the wheel was lightly dressed to remove any surface metal. The mean of three values was used for each composition and the results are plotted in FIG. 3. Standard Izod impact tests were also conducted according to ASTM Handbook E23, Type X except that the notch was U-shaped 2 mm deep and 1–3 mm diam., and the results are set forth in Table II below.

TABLE II

| % V | % C | Relative+ Wear | BHN | Izod* ft-lb 20° C. |
|---|---|---|---|---|
| 1.88 | 0.95 | /.319 | — | — |
| 1.28 | 1.42 | /.263 | — | — |
| 0.12 | 1.14 | 1.0/1.0 | 178/191 | Considerably beyond capability of machine |
| 0.47 | 1.27 | .79/.73 | 191/218 | Beyond capability of machine |
| 0.96 | 1.38 | .59/.46 | 218/246 | 117 |
| 2.22 | 1.50 | .44/.16 | 242/270 | 117 |
| 3.29 | 1.23 | .42/.18 | 264/280 | 118 |

+The first number refers to a specimen subjected to Type I heat treatment. The second number refers to a specimen subjected to Type II heat treatment.
*These specimens were subjected to Type II heat treatment.

Figure 3:
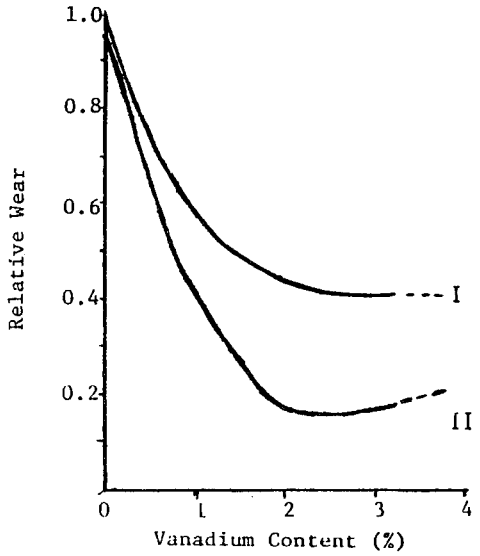
FIG. 3 is a graph illustrating relative wear versus percentage vanadium in austenitic manganese steel in different heat treated conditions.
Figure 4:
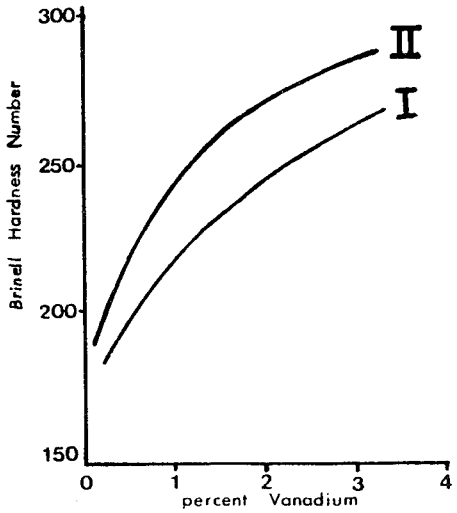
FIG. 4 is a graph illustrating Brinell hardness versus vanadium content in austenitic manganese steels heat treated as in FIG. 3.

As can be clearly seen in FIG. 3 the addition of 2% vanadium to Hadfield's steel can produce up to a remarkable five fold increase in wear resistance and provided an appropriate heat treatment is effected the impact strength of the alloy is scarcely affected. Hardness values as plotted in FIG. 4 show, as would be expected, that hardness increases with increasing vanadium content. Impact testing (Table II) indicates that the Type II heat treatment give superior properties even to standard Hadfield's steel. Values in excess of 120 foot-pounds were obtained whereas commercial Hadfield's steel gives only 100 foot-pounds.

For reasons of economy there seems little point in increasing the vanadium content above 2% as little or no further increase in wear resistance is achieved.

We claim:

1. A wear resistant austenitic manganese steel alloy consisting essentially of about:

carbon: 1.1 to 1.4%
manganese: 10 to 14%
silicon: 1% max.
sulphur: 0.06% max.
phosphorus: 0.12% max.
vanadium: 1.2 to 2%
iron: balance having an austenitic matrix structure with vanadium carbide particles substantially uniformly distributed therein.

2. An alloy as claimed in claim 1 having an impact strength (Izod) of at least 117 ft.-lb. at 20° C.

3. A method of heat treating an alloy consisting essentially of:

carbon: 1.1 to 1.4%
manganese: 10 to 14%
silicon: 1% max.
sulphur: 0.06% max.
phosphorus: 0.12% max.
vanadium: 1.2 to 2%
iron: balance comprising soaking said alloy at a temperature in the range 1050°–1150° C. for at least 6 hours per inch of section and water quenching.

4. A method of heat treating an alloy consisting essentially of:

carbon: 1.1 to 1.4%
manganese: 10 to 14%
silicon: 1% max.
sulphur: 0.06% max.
phosphorus: 0.12% max.
vanadium: 1.2 to 2%
iron: balance comprising soaking said alloy at a temperature in the range 1100°–1150° C. for at least 20 minutes per inch of section, water quenching, annealing at 950° C. for at least 6 hours per inch of section and water quenching.

* * * * *